US009646798B2

(12) United States Patent
Hyde et al.

(10) Patent No.: US 9,646,798 B2
(45) Date of Patent: May 9, 2017

(54) ELECTRONIC DEVICE GRAPHENE GRID

(75) Inventors: Roderick A. Hyde, Redmond, WA (US); Jordin T. Kare, Seattle, WA (US); Nathan P. Myhrvold, Medina, WA (US); Tony S. Pan, Cambridge, MA (US); Lowell L. Wood, Jr., Bellevue, WA (US)

(73) Assignee: ELWHA LLC, Bellevue, WA (US)

( * ) Notice: Subject to any disclaimer, the term of this patent is extended or adjusted under 35 U.S.C. 154(b) by 71 days.

(21) Appl. No.: 13/612,129

(22) Filed: Sep. 12, 2012

(65) Prior Publication Data

US 2013/0169142 A1 Jul. 4, 2013

Related U.S. Application Data

(63) Continuation-in-part of application No. 13/374,545, filed on Dec. 30, 2011, now Pat. No. 8,575,842, and a continuation-in-part of application No. 13/545,504, filed on Jul. 10, 2012, now Pat. No. 9,018,861, and a continuation-in-part of application No. 13/587,762, filed on Aug. 16, 2012, now Pat. No. 8,692,226.

(60) Provisional application No. 61/631,270, filed on Dec. 29, 2011, provisional application No. 61/637,986, filed on Apr. 25, 2012.

(51) Int. Cl.
*H01J 3/02* (2006.01)

(52) U.S. Cl.
CPC ..... *H01J 3/021* (2013.01); *H01J 2203/0232* (2013.01); *Y10T 29/49204* (2015.01)

(58) Field of Classification Search
CPC ..... H01J 19/38; H01J 2203/0232
See application file for complete search history.

(56) References Cited

U.S. PATENT DOCUMENTS

| | | | | |
|---|---|---|---|---|
| 2,404,919 A | | 7/1946 | Overbeck | |
| 2,489,850 A | | 11/1949 | Baker | |
| 2,744,960 A | | 5/1956 | Greefkes et al. | |
| 2,798,963 A | | 7/1957 | Saget | |
| 3,254,244 A | | 5/1966 | Gottlieb et al. | |
| 4,274,035 A | | 6/1981 | Fukuhara et al. | |
| 4,427,886 A | | 1/1984 | Martin et al. | |
| 4,721,885 A | * | 1/1988 | Brodie | H01J 17/48 313/309 |
| 5,177,402 A | | 1/1993 | Howard et al. | |
| 5,272,411 A | | 12/1993 | Francisco et al. | |
| 5,371,371 A | | 12/1994 | Yamazaki et al. | |
| 5,376,184 A | | 12/1994 | Aspden | |

(Continued)

FOREIGN PATENT DOCUMENTS

| | | |
|---|---|---|
| CN | 1069828 A | 3/1993 |
| CN | 1481542 A | 3/2004 |

(Continued)

OTHER PUBLICATIONS

PCT International Search Report; International App. No. PCT/US13/38249; Nov. 5, 2013; pp. 1-4.

(Continued)

*Primary Examiner* — Nimeshkumar Patel
*Assistant Examiner* — Jacob R Stern

(57) ABSTRACT

A device includes an anode, a cathode, and a grid configured to modulate a flow of electrons from the cathode to anode. The grid is made of graphene material which is substantially transparent to the flow of electrons.

42 Claims, 8 Drawing Sheets

100

(56) References Cited

U.S. PATENT DOCUMENTS

| | | | | |
|---|---|---|---|---|
| 5,386,172 | A | 1/1995 | Komatsu | |
| 5,548,138 | A | 8/1996 | Tanimoto et al. | |
| 5,578,901 | A | 11/1996 | Blanchet-Fincher et al. | |
| 5,606,215 | A | 2/1997 | Jaskie et al. | |
| 5,631,524 | A | 5/1997 | Matsuzaki et al. | |
| 5,717,279 | A | 2/1998 | Imura | |
| 5,834,781 | A | 11/1998 | Fukuhara | |
| 5,838,096 | A | 11/1998 | Shinada et al. | |
| 5,850,120 | A | 12/1998 | Okamoto | |
| 5,908,699 | A | 6/1999 | Kim | |
| 5,936,348 | A | 8/1999 | Shimoi et al. | |
| 5,936,354 | A | 8/1999 | Smith et al. | |
| 5,942,834 | A | 8/1999 | Davis | |
| 5,982,095 | A | 11/1999 | Jin et al. | |
| 6,031,336 | A | 2/2000 | Rumbaugh et al. | |
| 6,104,143 | A | 8/2000 | Bonavia | |
| 6,205,790 | B1 | 3/2001 | Denkin et al. | |
| 6,249,080 | B1 | 6/2001 | Komoda et al. | |
| 6,313,587 | B1 | 11/2001 | MacLennan et al. | |
| 6,346,931 | B1 | 2/2002 | Cathey et al. | |
| 6,373,175 | B1 | 4/2002 | Cade et al. | |
| 6,404,089 | B1 | 6/2002 | Tomion | |
| 6,538,367 | B1 | 3/2003 | Choi et al. | |
| 6,590,320 | B1 | 7/2003 | Abanshin et al. | |
| 6,621,096 | B2 | 9/2003 | Lee et al. | |
| 6,632,113 | B1 | 10/2003 | Noma et al. | |
| 6,949,887 | B2 | 9/2005 | Kirkpatrick et al. | |
| 7,061,188 | B1 | 6/2006 | Katyl et al. | |
| 7,122,967 | B2 | 10/2006 | Jo et al. | |
| 7,157,849 | B2 | 1/2007 | Seon et al. | |
| 7,173,366 | B2 | 2/2007 | Choi et al. | |
| 7,268,480 | B2 | 9/2007 | Choi et al. | |
| 7,462,979 | B2 * | 12/2008 | Konishi et al. | 313/306 |
| 7,710,013 | B2 | 5/2010 | Tatsumi et al. | |
| 7,741,764 | B1 | 6/2010 | Sung | |
| 7,750,462 | B1 | 7/2010 | Cohn et al. | |
| 7,825,591 | B2 | 11/2010 | Kimiya et al. | |
| 7,903,789 | B2 | 3/2011 | Morton et al. | |
| 8,018,169 | B2 | 9/2011 | Jeong et al. | |
| 8,089,206 | B2 | 1/2012 | Wei et al. | |
| 8,089,579 | B1 | 1/2012 | Johnson et al. | |
| 8,674,300 | B2 | 3/2014 | Adamec | |
| 2002/0036452 | A1 | 3/2002 | Muroyama et al. | |
| 2003/0001490 | A1 | 1/2003 | Yamamoto et al. | |
| 2003/0006684 | A1 * | 1/2003 | Kawate | B01J 23/44 313/311 |
| 2003/0124944 | A1 | 7/2003 | Kyogaku et al. | |
| 2003/0132393 | A1 | 7/2003 | Dimitrijevic et al. | |
| 2004/0004588 | A1 | 1/2004 | Kawase et al. | |
| 2004/0036402 | A1 | 2/2004 | Keesmann et al. | |
| 2004/0050415 | A1 | 3/2004 | Kucherov et al. | |
| 2004/0118347 | A1 | 6/2004 | Groves et al. | |
| 2004/0131858 | A1 | 7/2004 | Burden et al. | |
| 2004/0226914 | A1 | 11/2004 | Dong et al. | |
| 2004/0238809 | A1 | 12/2004 | Adamec et al. | |
| 2005/0001598 | A1 | 1/2005 | Belokon et al. | |
| 2005/0016575 | A1 | 1/2005 | Kumar et al. | |
| 2005/0057168 | A1 | 3/2005 | Song et al. | |
| 2005/0151461 | A1 | 7/2005 | Tuck et al. | |
| 2005/0248256 | A1 | 11/2005 | Song et al. | |
| 2006/0139207 | A1 | 6/2006 | Nikonov | |
| 2006/0261724 | A1 | 11/2006 | DiCarlo | |
| 2006/0273301 | A1 | 12/2006 | Moddel et al. | |
| 2006/0284539 | A1 | 12/2006 | Sung | |
| 2007/0023621 | A1 | 2/2007 | Blick et al. | |
| 2007/0046163 | A1 | 3/2007 | Sata et al. | |
| 2007/0158588 | A1 | 7/2007 | Zhou et al. | |
| 2008/0001513 | A1 | 1/2008 | Chen et al. | |
| 2008/0017237 | A1 | 1/2008 | Bray et al. | |
| 2008/0100235 | A1 | 5/2008 | Lin et al. | |
| 2009/0011706 | A1 | 1/2009 | Wilson et al. | |
| 2009/0115305 | A1 | 5/2009 | Segal et al. | |
| 2009/0146583 | A1 | 6/2009 | Bhadri et al. | |
| 2009/0194870 | A1 | 8/2009 | Nathanson et al. | |
| 2009/0303654 | A1 | 12/2009 | Fan et al. | |
| 2010/0019648 | A1 | 1/2010 | Yasuda et al. | |
| 2010/0026160 | A1 | 2/2010 | Terui et al. | |
| 2010/0066245 | A1 | 3/2010 | Van Spijker | |
| 2010/0090579 | A1 | 4/2010 | Sellmair | |
| 2010/0090601 | A1 | 4/2010 | Eisen et al. | |
| 2010/0102325 | A1 | 4/2010 | Kim et al. | |
| 2010/0108882 | A1 | 5/2010 | Zewail | |
| 2010/0271003 | A1 | 10/2010 | Jensen et al. | |
| 2010/0283436 | A1 * | 11/2010 | Chung | H02M 1/15 323/212 |
| 2010/0295486 | A1 | 11/2010 | Ikehashi | |
| 2010/0329964 | A1 | 12/2010 | Roos | |
| 2011/0037400 | A1 | 2/2011 | Kim et al. | |
| 2011/0088954 | A1 | 4/2011 | DiGiovanni et al. | |
| 2011/0139203 | A1 | 6/2011 | Yap | |
| 2011/0147761 | A1 | 6/2011 | Yu et al. | |
| 2011/0186805 | A1 | 8/2011 | Bowers et al. | |
| 2011/0192976 | A1 | 8/2011 | Own et al. | |
| 2011/0201201 | A1 | 8/2011 | Arnold et al. | |
| 2011/0226960 | A1 | 9/2011 | Zhang et al. | |
| 2012/0006784 | A1 | 1/2012 | Lin et al. | |
| 2012/0041370 | A1 | 2/2012 | Moberg et al. | |
| 2013/0168635 | A1 | 7/2013 | Cheatham, III et al. | |
| 2013/0169108 | A1 | 7/2013 | Cheatham, III et al. | |
| 2013/0169156 | A1 | 7/2013 | Hyde et al. | |
| 2013/0169193 | A1 | 7/2013 | Hyde et al. | |
| 2013/0221843 | A1 | 8/2013 | Cheatham, III et al. | |
| 2013/0229105 | A1 | 9/2013 | Cheatham, III et al. | |
| 2013/0229133 | A1 | 9/2013 | Cheatham, III et al. | |
| 2013/0313980 | A1 | 11/2013 | Cheatham, III et al. | |
| 2014/0070696 | A1 | 3/2014 | Cheatham, III et al. | |
| 2014/0333213 | A1 | 11/2014 | Cheatham, III et al. | |

FOREIGN PATENT DOCUMENTS

| | | | |
|---|---|---|---|
| CN | 1816684 | A | 8/2006 |
| CN | 10-1635245 | A | 1/2010 |
| CN | 102 339 699 | A | 2/2012 |
| CN | 102339699 | A | 2/2012 |
| EP | 1 063 197 | A2 | 12/2000 |
| JP | 2005539401 | A | 12/2005 |
| TW | 451256 | B | 8/2001 |
| WO | WO 2013/101937 | A1 | 7/2013 |

OTHER PUBLICATIONS

Japanese Patent Office; Notice of Rejection; App. No. 2009-500523; Mar. 21, 2013 (received by our agent on Mar. 26, 2013); 6 total pages (3 pages with English Machine Translation).

PCT International Search Report; International App. No. PCT/US2013/038254; Aug. 26, 2013; pp. 1-2.

PCT International Search Report; International App. No. PCT/US13/38476; Aug. 26, 2013; pp. 1-2.

PCT International Search Report; International App. No. PCT/US2013/038233; Oct. 4, 2013; pp. 1-5.

Britnell et al.; "Electron Tunneling Through Ultrathin Boron Nitride Crystalline Barriers"; NANO Letters; bearing dates of Jan. 18, 2012, Feb. 14, 2012 and Mar. 1, 2012; pp. 1707-1710; vol. 12; American Chemical Society.

Brodie et al. "Vacuum Microelectronic Devices"; Proceedings of the IEEE; Jul. 1994; pp. 1006-1034; vol. 82, No. 7; IEEE.

Choi et al.; "A Simple Structure and Fabrication of Carbon-Nanotube Field Emission Display"; Applied Surface Science; bearing dates of Mar. 24, 2003 and Jul. 20, 2003; pp. 370-374; vol. 221; Elsevier B.V.

Chou et al.; "Sub-10 nm Imprint Lithography and Applications"; J. Vac. Sci. Technol. B; Nov./Dec. 1997; pp. 2897-2904; vol. 15, No. 6; American Vacuum Society.

Chung et al.; "Energy Exchange Processes in Electron Emission at High Fields and Temperatures"; J. Vac. Sci. Technol. B; Mar./Apr. 1994; pp. 727-736; vol. 12, No. 2; American Vacuum Society.

Dean et al.; "Current Saturation Mechanisms in Carbon Nanotube Field Emitters"; Applied Physics Letters; Jan. 17, 2000; pp. 375-377; vol. 76; No. 3; American Institute of Physics.

(56) References Cited

OTHER PUBLICATIONS

Desplat et al.; "Interaction of Cesium and Oxygen on W(110)"; Surface Science; 1980 (and bearing dates of Jun. 18, 1979 and Sep. 14, 1979); pp. 97-118; vol. 92; North-Holland Publishing Company.
Ding, Meng; "Field Emission from Silicon"; Paper submitted to the Department of Physics at Massachusetts Institute of Technology; Jun. 2001; 277 pp. total; Massachusetts Institute of Technology.
Fisher et al.; "Thermal and Electrical Energy Transport and Conversion in Nanoscale Electron Field Emission Processes"; Transactions of the ASME; Oct. 2002; pp. 954-962; vol. 124; ASME.
Fursey, George N.; Field Emission in Vacuum Microelectronics (1st Edition); Jan. 21, 2005; 205 pages; ISBN-10: 0306474506 and ISBN-13: 978-0306474507; Springer (entire book cited, but not provided).
Han et al.; "Vacuum Nanoelectronics: Back to the Future?—Gate Insulated Nanoscale Vacuum Channel Transistor"; Applied Physics Letters; bearing dates of Feb. 24, 2012, Apr. 22, 2012 and May 23, 2012; pp. 213505-1-213505-4; vol. 100; American Institute of Physics.
Himpsel et al.; "Quantum Photoyield of Diamond(111)—A Stable Negative-Affinity Emitter"; Physical Review B; Jul. 15, 1979; pp. 624-627; vol. 20; No. 2; The American Physical Society.
Hishinuma et al.; "Refrigeration by Combined Tunneling and Thermionic Emission in Vacuum: Use of Nanometer Scale Design"; Applied Physics Letters; Apr. 23, 2001; cover page and pp. 2572-2574; vol. 78; No. 17; American Institute of Physics.
Hu, Chenming; "Gate Oxide Scaling Limits and Projection"; International Electron Devices Meeting 1996, IEEE, pp. 319-322.
Humphrey et al.; "Power Optimization in Thermionic Devices"; J. Phys. D: Appl. Phys.; bearing dates of Nov. 11, 2004, Jun. 3, 2005 and 2005; pp. 2051-2054; vol. 38; IOP Publishing Ltd.
Humphrey et al.; "Reversible Quantum Brownian Heat Engines for Electrons"; Physical Review Letters; Sep. 9, 2002; pp. 116801-1-116801-4; vol. 89, No. 11; The American Physical Society.
Kusunoki et al.; "Highly Efficient and Long Life Metal-Insulator-Metal Cathodes"; J. Vac. Sci. Technol. B—Microelectronics and Nanometer Structures; Jul./Aug. 2012; pp. 041202-1-041202-8; vol. 30; No. 4; American Vacuum Society.
Lovicott, Dominick; "Electron Emission Thermal Energy Conversion"; Thesis presented to the Graduate School Faculty at the University of Missouri at Columbia; Jul. 2010; pp. 1-141 and 22 addit. pages which incl. title page, signature page, acknowledgements, abstract, table of contents, list of figures, list of tables, and nomenclature; University of Missouri—Columbia.
Mammana et al.; "Field Emission Device With Back Gated Structure"; J.Vac. Sci. Technol. A—Vacuum, Surfaces, and Films; Jul./Aug. 2004; pp. 1455-1460; vol. 22; No. 4; American Vacuum Society.
Marcus et al.; "Formation of Silicon Tips with <1 nm Radius"; Applied Physics Letters; Jan. 15, 1990; pp. 236-238; vol. 56; No. 3; American Institute of Physics.
Medvedev et al.; "Generation of Magnetic Fields in the Relativistic Shock of Gamma-Ray-Burst Sources"; The Astrophysical Journal; Dec. 1, 1999; pp. 697-706;vol. 526; The American Astronomical Society.
Milanovic et al.; "Micromachining Technology for Lateral Field Emission Devices"; IEEE Transactions on Electron Devices; Jan. 2001; pp. 166-173; vol. 48; No. 1; IEEE.
Mimura et al.; "Improvement of the Emission Current from a Cesiated Metal-Oxide-Semiconductor Cathode"; Applied Physics Letters; bearing dates of Oct. 6, 2005, Feb. 6, 2006 and Mar. 24, 2006; pp. 123514-1-123514-3; vol. 88; American Institute of Physics.
Mishra et al.; "Model of Work Function of Tungsten Cathodes with Barium Oxide Coating"; Journal of Applied Physics; Mar. 15, 2004; pp. 3069-3074; vol. 95, No. 6; American Institute of Physics.
Nakpathomkum et al.; "Thermoelectric Efficiency at Maximum Power in Low-Dimensional Systems"; Oct. 7, 2010; pp. 1-13.
Nasibulin et al.; "A Novel Hybrid Carbon Material;" Nature Nanotechnology; Mar. 2007; pp. 156-161; vol. 2; Nature Publishing Group.
O'Dwyer et al.; "Electronic Efficiency in Nanostructured Thermionic and Thermoelectric Devices"; Physical Review B; bearing dates of 2005, Jun. 15, 2005, Sep. 6, 2005 and Nov. 21, 2005; pp. 205330-1-205330-10; vol. 72; Issue 205330; The American Physical Society.
Ottens et al.; "Near-Field Radiative Heat Transfer Between Macroscopic Planar Surfaces"; Physical Review Letters; Jul. 1, 2011; pp. 014301-1-014301-4; vol. 107, Issue 014301; American Physical Society.
Pan et al.; "Field Emission Heat Engines II"; Intellectual Ventures internal white paper; created on May 15, 2012 and printed on Aug. 2, 2012; pp. 1-43.
Pan et al.; "Field Emission Heat Engines"; printed on Dec. 28, 2011; 92 pp. total (incl. cover sheet, table of contents).
PCT International Search Report; International App. No. PCT/US2012/071841; Mar. 1, 2013; pp. 1-2 (additional 4 pages of Search History).
PCT International Search Report; International App. No. PCT/US2012/071845; Mar. 4, 2013; pp. 1-3.
PCT International Search Report; International App. No. PCT/US2012/071849; Feb. 27, 2013; pp. 1-3 (additional 3 pages of Search History).
Rasor, Ned S.; "Thermionic Energy Conversion Plasmas"; IEEE Transactions on Plasma Science; Dec. 1991; pp. 1191-1208; vol. 19, No. 6; IEEE.
Schwede et al.; "Photon-Enhanced Thermionic Emission for Solar Concentrator Systems"; Nature Materials; Sep. 2010; pp. 762-767; vol. 9.
Shakouri, Ali; "Nanoscale Devices for Solid State Refrigeration and Power Generation"; 20th IEEE SEMI-THERM Symposium; bearing a date of 2004 and printed on Dec. 28, 2011; pp. 1-10; IEEE.
Shaw et al.; "Method and Structure for Local Emission Regulation and Arc Prevention in Field Emitter Arrays"; J.Vac. Sci. Technol. B; Mar./Apr. 2005; pp. 836- 839; vol. 23; No. 2.
Spindt et al.; "Physical Properties of Thin-Film Field Emission Cathodes with Molybdenum Cones"; Journal of Applied Physics; Dec. 1976; pp. 5248-5263; vol. 47; No. 12; American Institute of Physics.
Tsu et al.; "Tunneling in a Finite Superlattice"; Appl. Phys. Lett.; Jun. 1, 1973; pp. 562-564; vol. 22, No. 11; American Institute of Physics.
Tuckerman et al.; High-Performance Heat Sinking for VLSI; IEEE Electron Device Letters; May 1981; pp. 126-129; vol. EDL-2, No. 5; IEEE.
Tuckerman et al.; "Microchannel Heat Transfer: Early History, Commercial Applications, and Emerging Opportunities"; Proceedings of the ASME 2011 9th International Conference on Nanochannels, Microchannels and Minichannels in Edmonton, Alberta, Canada; Jun. 19-22, 2011; pp. 1-18; ASME.
Vining, Cronin B.; "An Inconvenient Truth About Thermoelectrics"; Nature Materials; Feb. 2009; pp. 83-85; vol. 8; Macmillan Publishers Limited.
Westover, Tyler L.; "Energy Transport and Conversion in Electron Emission Processes"; A Dissertation submitted to the Faculty of Purdue University in West Lafayette, Indiana; Aug. 2008; pp. 1-236 plus addit. 20 pages incl. Dissertation Acceptance form, Research Integrity and Copyright Disclaimer form; title page, acknowledgements, table of contents, list of tables, list of figures, and abstract; ProQuest LLC, Ann Arbor, MI.
Yang et al.; "Monochromatic Electron Photoemission from Diamondoid Monolayers"; created on Aug. 2, 2012; 26 pages total (incl. Figs. & Supporting Online Material addendum of 8 pgs.).
Zhu et al.; "Large Current Density from Carbon Nanotube Field Emitters"; Applied Physics Letters; Aug. 9, 1999; pp. 873-875; vol. 75; No. 6; American Institute of Physics.
Zhu, Wei; Vacuum Microelectronics (1st Edition); Sep. 21, 2001; 396 pages; ISBN-10: 047132244X and ISBN-13: 978-04713224443; Wiley—Interscience (entire book cited, but not provided).

(56) References Cited

OTHER PUBLICATIONS

PCT International Search Report; International App. No. PCT/US2012/071837; Mar. 11, 2013; pp. 1-3 (plus 4 pages of search history information).
PCT International Search Report; Application No. PCT/US2012/071833; Mar. 8, 2013; pp. 1-3 (Plus 5 pages search history information).
The State Intellectual Property Office of P.R.C., First Office Action, App. No. 2013/80015575.4 (Based on PCT Patent Application No. PCT/US2013/038254); Feb. 3, 2016 (received by our Agent on Feb. 13, 2016); pp. 1-11 (machine translation, as provided).
European Search Report; European App. No. EP 12 86 3524; Jul. 9, 2015 (received by our agent on Jul. 6, 2015); pp. 1-10.
Stephanos, Cyril; "Thermoelectronic Power Generation from Solar Radiation and Heat"; Dec. 17, 2012; pp. 1-151; located at: http://opus.bibliothek.uni-augsburg.de/opus4/files/2253/Dissertation_Stephanos.pdf.
European Patent Office, Supplementary European Search Report, Pursuant to Rule 62 EPC; App. No. EP12861564; Jul. 23, 2015 (received by our Agent on Jul. 20, 2015); pp. 1-6.
PCT International Search Report; International App. No. PCT/US2015/030749; Aug. 27, 2015; pp. 1-4.
European Patent Office, Supplementary European Search Report, Pursuant to Rule 62 EPC; App. No. EP 12863100; Oct. 7, 2015 (received by our Agent on Oct. 14, 2015); pp. 1-6.
The State Intellectual Property Office of P.R.C., Notification of the First Office Action; App. No. 201280070838.7; Nov. 25, 2015, (received by our agent on Dec. 2, 2015); pp. 1-6 (machine translation provided).
State Intellectual Property Office of P.R.C., Notification of the First Office Action; Chinese Patent App. No. 201280070924.8; Nov. 25, 2015, (received by our agent on Dec. 2, 2015); 8 pages (machine translation provided).
Chinese State Intellectual Property Office, Notification of the First Office Action, App. No. 2012/80070914.4; Apr. 20, 2016 (received by our Agent on Apr. 27, 2016) pp. 1-13 (machine translation provided).
The State Intellectual Property Office of P.R.C., First Office Action, App. No. 2012/80070857.X (Based on PCT Patent Application No. PCT/US2012/071837); Jun. 29, 2016 (received by our Agent on Jun. 24, 2016); pp. 1-13 (machine translation, as provided).
The State Intellectual Property Office of P.R.C.; Notification of the Second Office Action; App. No. 2013/80015575.4; Aug. 19, 2016 (received by our Agent on Aug. 23, 2016); pp. 1-4 (machine translation provided).
The State Intellectual Property Office of P.R.C.; Notification of the Second Office Action; App. No. 2012/80070924.8; Jul. 6, 2016 (received by our Agent on Jul. 11, 2016); pp. 1-3 (machine translation provided).
The State Intellectual Property Office of P.R.C.; Notification of the Second Office Action; App. No. 2012/80070838.7; Jul. 6, 2016 (received by our Agent on Jul. 11, 2016); pp. 1-7 (machine translation provided).
The State Intellectual Property Office of P.R.C., Second Office Action, App. No. 2012/80065581.6 (Based on PCT Patent Application No. PCT/US2012/071833); Jul. 22, 2016 (received by our Agent on Jul. 27, 2016); pp. 1-9 (machine translation, as provided).
Chinese State Intellectual Property Office, Decision of Final Rejection, App. No. 2012/80065581.6 (Based on PCT Patent Application No. PCT/US2012/071833); Dec. 21, 2015 (received by our Agent on Jan. 5, 2016); pp. 1-6 (machine translation provided, 6 pages total).
Bell et al.; "Precision Cutting and Patterning of Graphene with Helium Ions"; uploaded on Jul. 27, 2015; pp. 1-16.
Bieri et al.; "Porous graphenes: two-dimensional polymer synthesis with atomic precision"; Chemical Communications; Dec. 7, 2009; pp. 6919-6921; No. 45; The Royal Society of Chemistry.
Boukhvalov et al.; "Chemical functionalization of graphene"; Journal of Physics: Condensed Matter; Jul. 27, 2009; pp. 1-12; vol. 21; IOP Publishing Ltd.
Feenstra et al.; "Low-energy Electron Reflectivity from Graphene"; uploaded on Jul. 27, 2015; pp. 1-16.
Garaj et al.; "Graphene as a sub-nanometer trans-electrode membrane"; Nature; Sep. 9, 2010; pp. 1-13; vol. 467, No. 7312; National Institutes of Health.
Guo et al.; "Graphene Doping: A Review"; Insciences Journal, Nanotechnology; Apr. 27, 2011; pp. 80-89; vol. 1, No. 2; Insciences Journal.
Kim et al.; "Fabrication and Characterization of Large-Area, Semiconducting Nanoperforated Graphene Materials"; NANO Letters; Mar. 1, 2010; pp. 1125-1131; vol. 10; American Chemical Society.
McClain et al.; "First-principles theory of low-energy electron diffraction and quantum interference in few-layer graphene"; Materials Science Condensed Matter; Nov. 12, 2013; pp. 1-5; arXiv.org.
Mutus et al.; "Low Energy Electron Point Projection Microscopy of Suspended Graphene, the Ultimate 'Microscope Slide' "; Mesoscale and Nanoscale Physics Condensed Matter; Feb. 17, 2011; pp. 1-16, arXiv.org.
Yan et al.; "Time-Domain Simulation of Electron Diffraction in Crystals"; Dec. 8, 2011; pp. 1-25.
The State Intellectual Property Office of P.R.C., Third Office Action, App. No. 2012/80065581.6 (Based on PCT Patent Application No. PCT/US2012/071833); Dec. 7, 2016 (received by our Agent on Dec. 12. 2016); pp. 1-10 (machine translation, as provided).

* cited by examiner

100

200

300

500

600

700

800

ELECTRONIC DEVICE GRAPHENE GRID

CROSS-REFERENCE TO RELATED APPLICATIONS

The present application is related to and claims the benefit of the earliest available effective filing date(s) of the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications).

RELATED APPLICATIONS

The present application claims priority under 35 USC §119(e) to U.S. patent application Ser. No. 61/631,270, entitled FIELD EMISSION DEVICE, naming RODERICK A. HYDE, JORDIN T. KARE, NATHAN P. MYHRVOLD, TONY S. PAN, and LOWELL L. WOOD, JR., as inventors, filed 29 Dec. 2011, which is currently co-pending or is an application of which a currently co-pending application is entitled to the benefit of the filing date.

The present application is a continuation-in-part of U.S. patent application Ser. No. 13/374,545, entitled FIELD EMISSION DEVICE, naming RODERICK A. HYDE, JORDIN T. KARE, NATHAN P. MYHRVOLD, TONY S. PAN, and LOWELL L. WOOD, JR., as inventors, filed 30 Dec. 2011, which is currently co-pending or is an application of which a currently co-pending application is entitled to the benefit of the filing date.

The present application claims priority under 35 USC §119(e) to U.S. patent application Ser. No. 61/638,986, entitled FIELD EMISSION DEVICE, naming RODERICK A. HYDE, JORDIN T. KARE, NATHAN P. MYHRVOLD, TONY S. PAN, and LOWELL L. WOOD, JR., as inventors, filed 26 Apr. 2012, which is currently co-pending or is an application of which a currently co-pending application is entitled to the benefit of the filing date.

The present application is a continuation-in-part of U.S. patent application Ser. No. 13/545,504, entitled PERFORMANCE OPTIMIZATION OF A FIELD EMISSION DEVICE, naming RODERICK A. HYDE, JORDIN T. KARE, NATHAN P. MYHRVOLD, TONY S. PAN, and LOWELL L. WOOD, JR., as inventors, filed 10 Jul. 2012, which is currently co-pending or is an application of which a currently co-pending application is entitled to the benefit of the filing date.

The present application is a continuation-in-part of U.S. patent application Ser. No. 13/587,762, entitled MATERIALS AND CONFIGURATIONS OF A FIELD EMISSION DEVICE, naming JESSE R. CHEATHAM, III, PHILIP ANDREW ECKHOFF, WILLIAM GATES, RODERICK A. HYDE, MURIEL Y. ISHIKAWA, JORDIN T. KARE, NATHAN P. MYHRVOLD, TONY S. PAN, ROBERT C. PETROSKI, CLARENCE T. TEGREENE, DAVID B. TUCKERMAN, CHARLES WHITMER, LOWELL L. WOOD, JR., VICTORIA Y. H. WOOD, as inventors, filed Aug. 16, 2012, which is currently co-pending or is an application of which a currently co-pending application is entitled to the benefit of the filing date.

All subject matter of the Related Applications is incorporated by reference herein to the extent that such subject matter is not inconsistent herewith.

BACKGROUND

Electronic devices vary in structure and design, but invariably involve control of a flow of charged carriers (e.g., electrons or ions) between electrodes (i.e., an anode and a cathode). The flow of charged carriers may be a result of thermionic emission, which is the heat-induced flow of charge carriers from a surface or over a potential-energy barrier, from one of the electrodes. This emission occurs because the thermal energy given to the carrier overcomes the binding potential, also known as work function of the electrode. A classical example of thermionic emission is the emission of electrons from a hot cathode, into a vacuum (also known as the Edison effect) in a vacuum tube. The hot cathode can be a metal filament, a coated metal filament, or a separate structure of metal or carbides or borides of transition metals. The electronic devices may also exploit other physics phenomena (e.g., field electron emission or photoelectric emission) to produce the flow of charged carriers between the anode and the cathode.

The flow of the charged carriers or the emission of charged carriers from the electrode in an electronic device is influenced by proximate structures. For example, a vacuum tube device, in addition to the anode and cathode electrodes, can include one or more active electrodes (or grids) that influence the flow electrons in the device. Vacuum tube devices that include three, four, five and six electrodes, etc. are suggestively called triodes, tetrodes, pentodes, hexodes, etc. The grids in these devices can have different functions. For example, a voltage applied to a control grid that is ordinarily placed between the cathode and the anode of an electron tube serves to vary the flow of current. A screen grid that is ordinarily placed between the control grid and the anode acts as an electrostatic shield to protect the control grid from the influence of the anode when its potential changes. A suppressor grid that is ordinarily interposed between the screen grid and the anode acts as an electrostatic shield to suppress secondary emission from the anode.

Consideration is now being given grid structures and materials in electronic devices. Attention is directed to, but not limited to, micro- and nano-electronic devices in which an inter-electrode dimension may be a microscopic dimension.

SUMMARY

In one general aspect, a device includes an anode, a cathode, and a grid made of graphene material. The device may be micro or nano-electronic device. The grid may be configured to modulate a flow of electrons from the cathode to anode.

In one general aspect, a method for configuring a multi-electrode electronic device (e.g., a microelectronic or nano-electronic device) includes providing an anode, providing a cathode and providing a grid that is made of graphene material to modulate a flow of electrons from the cathode to anode. The method may include disposing the anode, the cathode and the grid in a vacuum-holding container to form the electronic device.

BRIEF DESCRIPTION OF THE DRAWINGS

The use of the same symbols in different drawings typically indicates similar or identical items.

DETAILED DESCRIPTION

Figure 1:
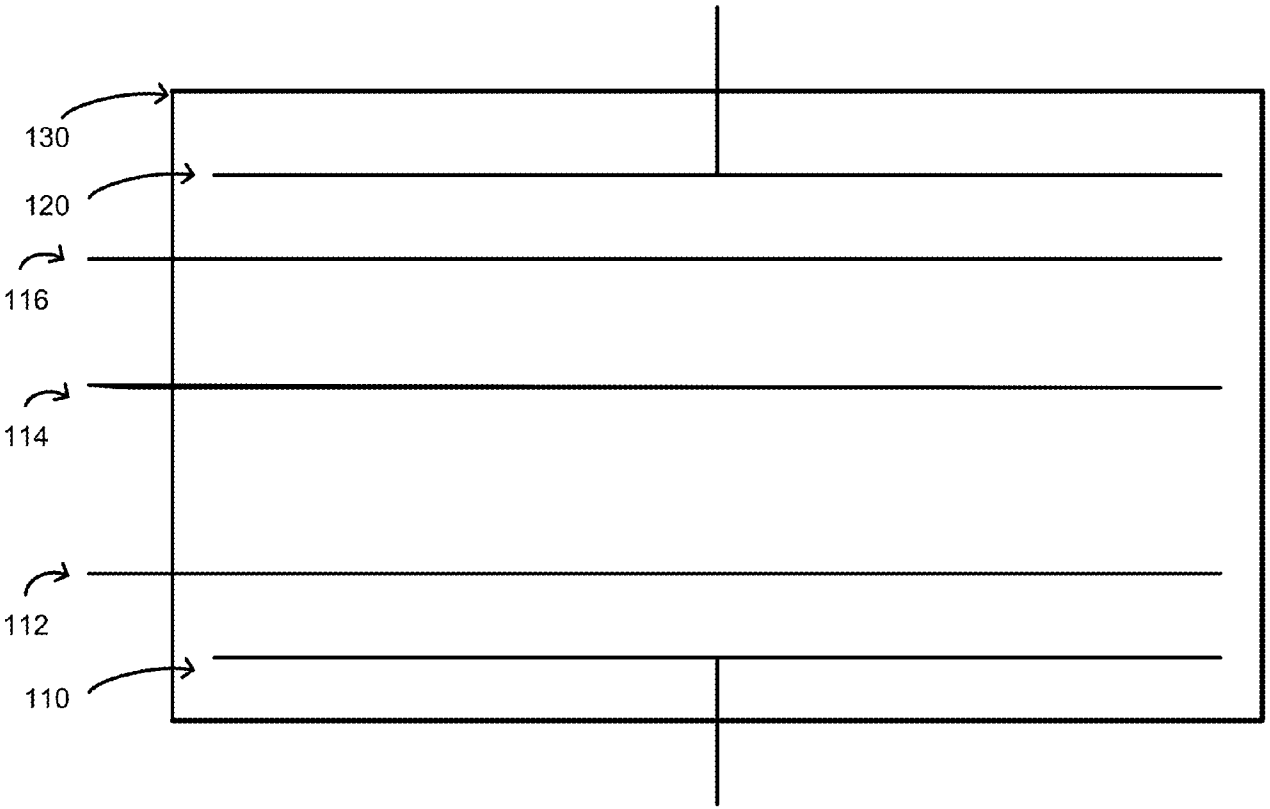
FIG. 1 is a schematic illustration of an exemplary multi-electrode electronic device, in accordance with the principles of the disclosure herein.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the principles of the disclosure herein.

In accordance with the principles of the disclosure herein, one or more grid electrodes of a multi-electrode electronic device are made from graphene materials.

FIG. 1 shows an example multi-electrode electronic device 100, in accordance with the principles of the disclosure herein. Multi-electrode electronic device 100 may, for example, be a microelectronic or a nanoelectronic device. Multi-electrode device 100 may include an anode 110, a cathode 120 and one or more grid electrodes (e.g., grids 112-116). Multi-electrode device 100 may be configured, for example, depending on the number and configuration of the grid electrodes therein, to operate as a triode, a tetrode, a pentode or other type of electronic device. In particular, multi-electrode device 100 may be configured to operate as a field emission device that is shown and described in U.S. patent application Ser. No. 13/374,545.

In conventional usage, the term cathode refers to an electron emitter and the term anode refers to an electron receiver. However, it will be understood that in the multi-electrode devices described herein the cathode and the anode may each act as an electron emitter or an electron receiver and therefore the terms anode and cathode may be understood by context herein. Under appropriate biasing voltages, a charged carrier flow may be established in multi-electrode device 100 between anode 110 and cathode 120. Anode 110 and/or cathode 120 surfaces may include field enhancement structures (e.g., field emitter tips, ridges, carbon nanotubes, etc.)

The charged carrier flow between anode 110 and cathode 120 may be controlled or otherwise influenced by the grid electrodes (e.g., grids 112-116). In the example shown, grids 112-116 may act, for example, as a control grid, a screening grid and a suppressor grid. The grid electrodes may control (i.e. modulate) the amount of the charged carrier flow between anode 110 and cathode 120 in the same manner as homonym grids control the charged carrier flow in traditional vacuum tubes by modifying the electrical potential profile or electrical field in the direction of the charged carrier flow between anode and cathode under appropriate biasing voltages. A positive bias voltage applied to a grid may, for example, accelerate electrons across the gap between anode 110 and cathode 120. Conversely, a negative positive bias voltage applied to a grid may decelerate electrons and reduce or stop the charged carrier flow between anode 110 and cathode 120. The vacuum-tube-like grid electrodes herein may be distinguished from ion or electron beam extraction electrodes (e.g., used in ion or electron beam sources) and electrodes of electrostatic lens structures that are used for collimating or focusing ion or electron beams (e.g., in electron beam microscopes and ion implanters).

Multi-electrode device 100 may be encased in container 130, which may isolate anode 110, cathode 120 and the one or more grid electrodes in a controlled environment (e.g., a vacuum or gas-filled region). The gas used to fill container 130 may include one or more atomic or molecular species, partially ionized plasmas, fully ionized plasmas, or mixtures thereof. A gas composition and pressure in container 130 may be chosen to be conducive to the passage of charged carrier flow between anode 110 and cathode 120. The gas composition, pressure, and ionization state in container 130 may be chosen to be conducive to the neutralization of space charges for charged carrier flow between anode 110 and cathode 120. The gas pressure in container 110 may, as in conventional vacuum tube devices, be substantially below atmospheric pressure. The gas pressure may be sufficiently low, so that the combination of low gas density and small inter-component separations reduces the likelihood of gas interactions with transiting electrons to low enough levels such that a gas-filled device offers vacuum-like performance In accordance with the principles of the disclosure herein one or more of the electrodes (e.g., electrodes 112-116) in multi-electrode device 100 may be made of graphene materials. The graphene materials used as electrode material may be substantially transparent to the flow of charged carriers between anode 110 and cathode 120 in device operation. Multi-electrode device 100 may include at least one control grid configured to modulate a flow of electrons from the cathode to anode. Additionally or alternatively, multi-electrode device 100 may include at least one screen grid configured to reduce parasitic capacitance and oscillations. The control grid and/or the screen grid may be made of graphene material.

Figure 2:
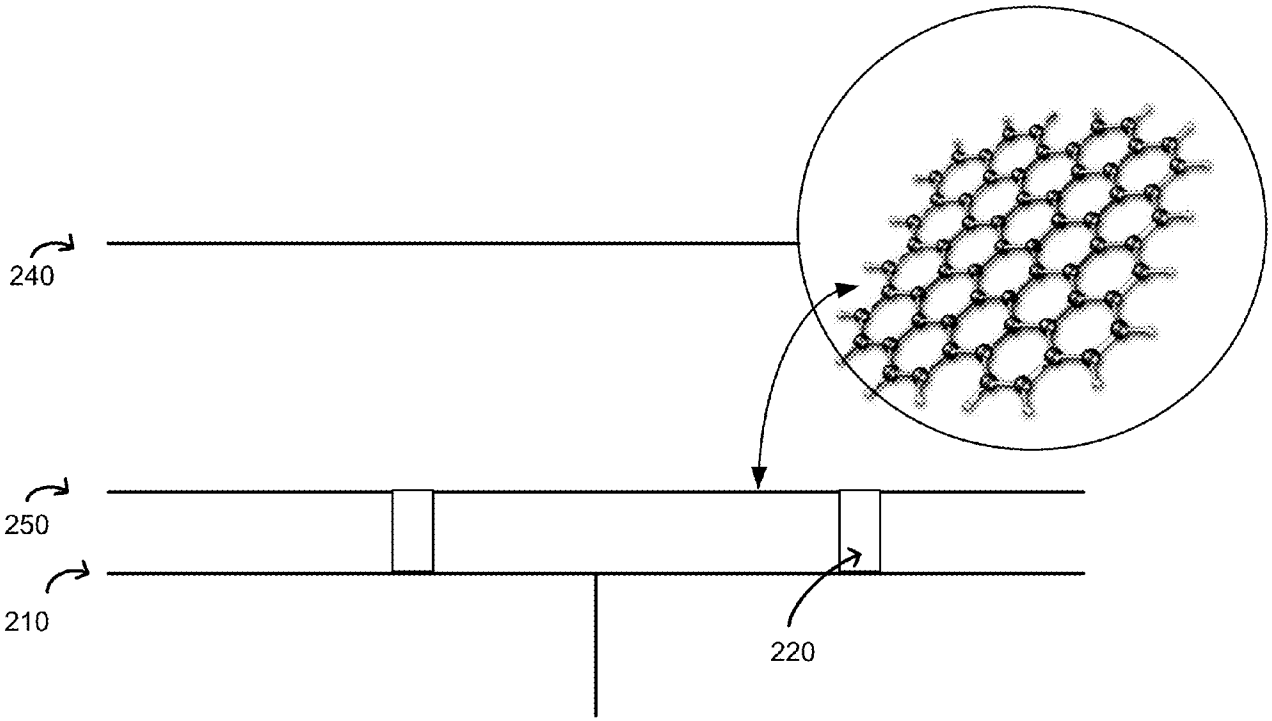
FIG. 2 is a schematic illustration of an example device in which a grid electrode made of graphene materials is disposed proximate to an anode or cathode electrode, in accordance with the principles of the disclosure herein.

FIG. 2 shows an example device 200 (which may be a version of multi-electrode device 100) having two electrodes 210 and 240 (e.g., cathode and anode) and a grid electrode 250 disposed proximate to one of the electrodes (e.g., electrode 210). Grid electrode 250 may incorporate graphene materials which are substantially transparent to a flow of electrons between electrodes 210 and 240. In device operation, the electrons flow between electrodes 210 and 240 may include electrons having energies, for example, of up to about 100 eV. Grid electrode 250 may, for example, be a control grid configured to modulate a flow of electrons from the cathode to anode. The control grid may be disposed sufficiently close to electrode 210 to induce or suppress electron emission from electrode 210 when a suitable electric potential is applied to the grid in device operation.

Graphene is an allotrope of carbon having a structure of one-atom-thick planar sheets of $sp^2$-bonded carbon atoms that are densely packed in a honeycomb crystal lattice, as shown, for example, in the inset in FIG. 2. The graphene materials may be in the form of sheets or ribbons and may include unilayer, bilayer or other forms of graphene. The graphene material of the control grid (e.g., grid electrode 250) may include a graphene sheet having an area of more than 0.1 $\mu m^2$.

A version of device 200 may have at least one relatively smooth planar anode or cathode surface over which graphene grid electrode 250 may be supported by a sparse array of conducting posts or walls. The conducting posts or walls may terminate on but are electrically isolated from the underlying anode or cathode. Grid electrode 250 may be formed, for example, by suspending free-standing graphene materials supported by scaffolding 220 over electrode 210. The smooth planar anode or cathode surface over which graphene grid electrode 250 may be supported may be a surface that is substantially planar on a micro- or nanometer scale. Further, a separation distance between the graphene material and the planar surface may be less than about 1 μm. In some experimental investigations of suspended graphene sheets, a separation distance between the graphene material and the planar surface is about 0.3 μm. In some device applications, the separation distance between the graphene material and the planar surface may be less than about 0.1 μm.

Scaffolding 220 may be configured to physically support the graphene material of grid electrode 250 over the planar surface of electrode 210. Scaffolding 220 may, for example, include an array of spacers or support posts. The spacers or support posts, which may include one or more of dielectrics, oxides, polymers, insulators and glassy material, may be electrically isolated from the planar surface of electrode 210.

Graphene, which has a local hexagonal carbon ring structure, may have a high transmission probability for electrons through the hexagonal openings in its structure. Further, electronic bandgaps in the graphene materials used for grid 250 may be suitably modified (e.g., by doping or functionalizing) to reduce or avoid inelastic electron scattering of incident electrons that may pass close to a carbon atom in the graphene structure. The doping and functionalizing techniques that are used to create or modify electronic bandgaps in the graphene materials may be the same or similar to techniques that are described, for example, in Beidou Guo et al. *Graphene Doping: A Review*, J. Insciences. 2011, 1 (2), 80-89, and in D. W. Boukhvalov et al. *Chemical functionalization of graphene, J. Phys.: Condens. Matter* 21 344205. For completeness, both of the foregoing references are incorporated by reference in their entireties herein.

The transmission probability of incident electrons from vacuum through graphene may be approximated as a quantum tunneling process through a model finite square potential well. The model potential well width may be set equal to the single-atom thickness of a graphene sheet ~0.3 nm, while the potential well depth may be approximated by the ~5 eV binding energy of vacuum electrons on the graphene lattice. Model calculations for electrons incident on such a model finite square potential well yield a transmission probability T of about 0.738 for 1 eV electrons and a transmission probability T of almost unity (T=0.996) for 10 eV electrons. The model calculations are consistent with transmission probabilities reported in the scientific literature. See e.g., Y. J. Mutus et al. *Low Energy Electron Point Projection Microscopy of Suspended Graphene, the Ultimate* "Microscope Slide," *New J. Phys.* 13 063011 (reporting measured transparency of graphene to electrons 100-200 eV to be about 74%); and J. Yan et al. *Time-domain simulation of electron diffraction in crystals*, Phys. Rev. B 84, 224117 (2011) (reporting the simulated transmission probability of low-energy electrons (20-200 eV) to be greater than about 80%).

However, as noted above, because of inelastic scattering processes, incident electrons may be expected to suffer detrimental energy losses due to interactions with electrons and phonons in graphene materials. These interactions may be expected to become dominant if the incident electron kinetic energy matches a relevant interaction energy. Fortunately, in graphene, optical phonons may have typical energies of about 200 meV, and acoustic phonons may have energies ranging from 0 to 50 meV. Therefore, ignoring electron-electron scattering, the tunneling or transmission probability of vacuum electrons through graphene may be expected to be close to unity for electrons having an energy >1 eV. Electron-phonon interactions may not be important or relevant to the transparency of the graphene grids to electron flow therethrough in electronic device operation.

In accordance with the principles of the disclosure herein, any effects of electron-electron scattering on the transparency of the graphene materials may be avoided or mitigated by bandgap engineering of the graphene materials used to make grid 250. Typical electric transition energies in raw or undoped graphene materials may be about 100 meV around the Dirac point. However, the electric transition energies may be expected to increase up to about 10 eV under very strong electric fields that may be applied in operation of device 200. Moreover, a concentration of induced charge carriers in graphene may be dependent on the external electric field with the proportionality between the induced charge carriers and the applied electric field of about 0.055 electrons/$nm^2$ per 1 V/nm electric field in vacuum. In accordance with the principles of the disclosure herein, energy losses due to electron-electron scattering in the graphene materials under a strong electric fields may be avoided, as noted above, by bandgap engineering of the graphene materials used for grid electrode 250. The graphene materials used for grid 250 may be provided with electronic bandgaps at suitable energies to permit through transmission of electron flow between electrodes 210 and 240 in device operation. The graphene materials with electronic bandgaps may be functionalized and/or doped graphene materials.

Figure 3:
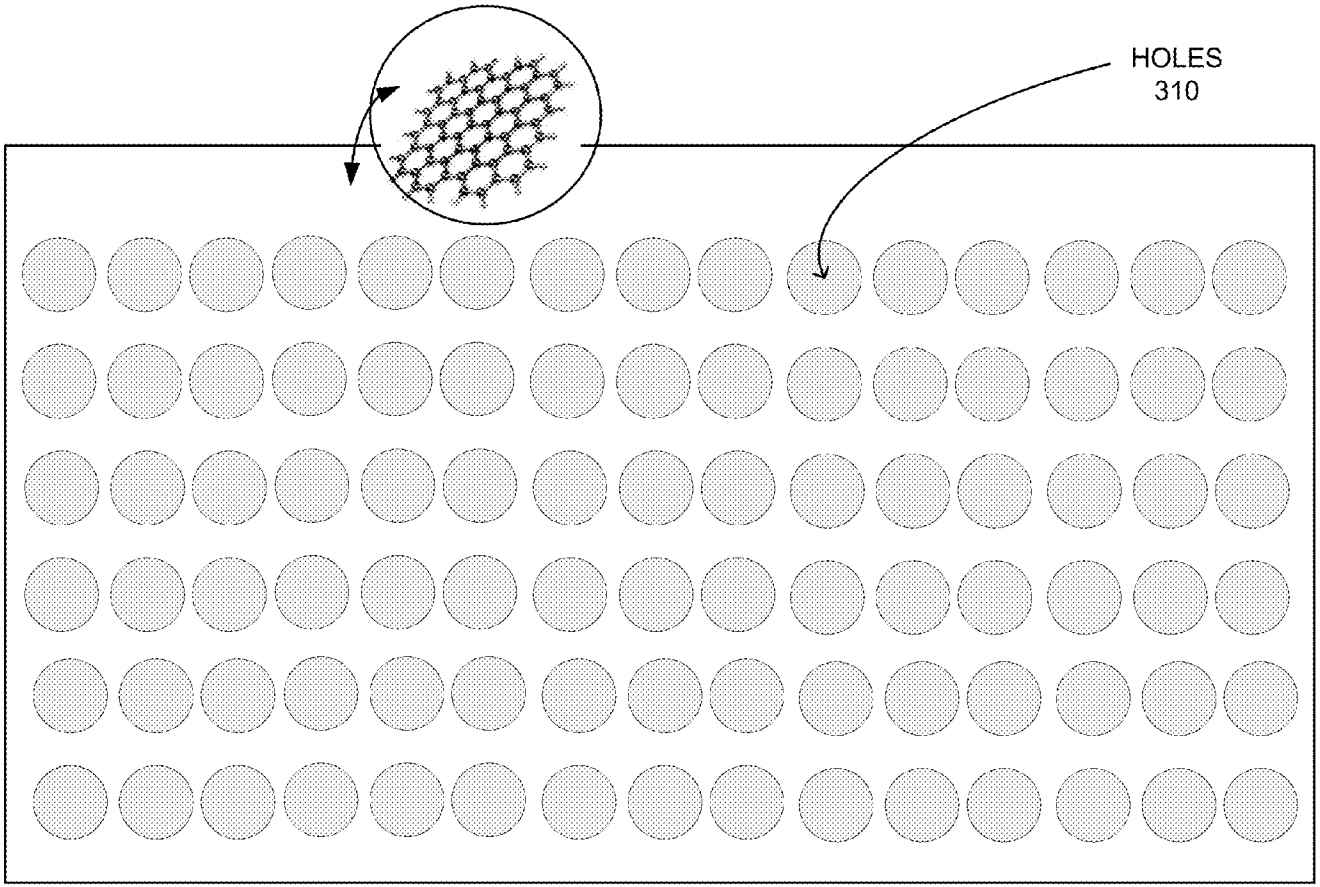
FIG. 3 is a schematic illustration of an example graphene sheet in which carbon atoms have been removed to form holes or apertures through which charge carriers may flow uninterrupted, in accordance with the principles of the disclosure herein.

In another version of multi-electrode device 100, the graphene materials used for an electrode may have holes or apertures formed therein to permit through passage of a flow of charged carriers between anode 110 and cathode 120 in device operation. The holes, which may be larger than a basic hexagon carbon ring or unit of graphene's atomic structure, may be formed by removing carbon atoms from a graphene sheet or ribbon. FIG. 3 shows schematically a graphene sheet 300 in which carbon atoms have been removed to form holes or apertures 310 through which charge carriers may flow uninterrupted.

Holes or apertures 310 (which may also be referred to herein as "pores") may be physically formed by processing graphene using any suitable technique including, for example, electron beam exposure, ion beam drilling, copolymer block lithography, diblock copolymer templating, and/or surface-assisted polymer synthesis. The named techniques are variously described, for example, in S. Garaj et al. *Graphene as a subnanometre trans-electrode membrane*, Nature 467, 190-193, (9 Sep. 2010); Kim et al. *Fabrication and Characterization of Large-Area, Semiconducting Nanoperforated Graphene Materials*, Nano Lett., 2010, 10 (4), pp. 1125-1131; D. C. Bell et al. *Precision Cutting and Patterning of Graphene with Helium Ions*, Nanotechnology 20 (2009) 455301; and Marco Bieri et al. *Porous graphenes: two-dimensional polymer synthesis with atomic precision*, Chemical Communications, 45 pp. 6865-7052, 7 Dec. 2009. For completeness, all of the foregoing references are incorporated by reference in their entireties herein.

Alternatively or additionally, nano-photolithographic and etching techniques may be used to create a pattern of holes in the graphene materials used as an electrode. In an example hole-forming process, graphene deposited on a substrate may be patterned by nanoimprint lithography to create rows of highly curved regions, which are then etched away to create an array of very small holes in the graphene material. The process may exploit the enhanced reactivity of carbon atoms along a fold or curve in the graphene material to preferentially create holes at the curved regions.

Figure 4:
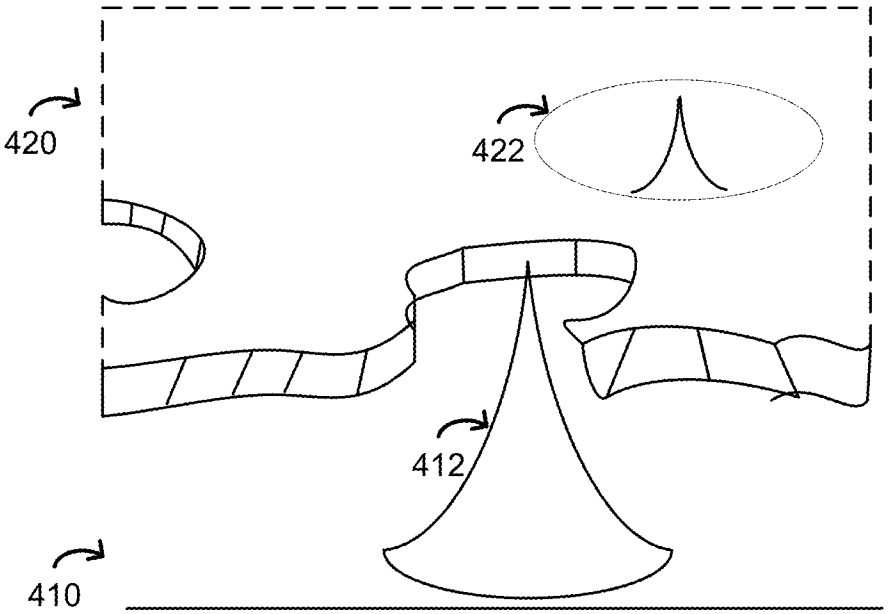
FIG. 4 is a schematic illustration of an example graphene electrode disposed above an electrode having field emitter tip array such that holes in the graphene electrode are aligned with field emitter tip array, in accordance with the principles of the disclosure herein.

For a version of multi-electrode device 100 in which an electrode (e.g., electrode 110) has a surface topography that includes, for example, an array of field emitter tips for enhanced field emission, a graphene sheet used for a proximate grid electrode (e.g., electrode 112) may be mechanically placed on the array of field tips. Such placement may be expected to locally curve or mechanically stress the graphene sheet, which after etching may result in apertures or holes that are automatically aligned with the field emitter tips. FIG. 4 shows an example graphene electrode 420 disposed above an electrode 410 having a field emitter tip array 412. Holes 422 formed in graphene electrode 420 are shown as being aligned with field emitter tip array 412. Holes 422 may be created by a self-aligning process of placing a graphene sheet over electrode 410 in mechanical contact with field emitter tip array 412 and etching the graphene regions stressed by mechanical contact with the field emitter tips.

In an example multi-electrode device 100, the graphene material used for making a grid electrode includes a graphene sheet with physical pores formed by carbon atoms removed therein. A size distribution of the physical pores may be selected upon consideration of device design parameters. Depending on the device design, the pores may have cross-sectional areas, for example, in a range of about 1 $nm^2$-100 $nm^2$ or 100 $nm^2$-1000 $nm^2$.

The foregoing example grid electrodes made of graphene materials (e.g., electrodes 250, and 420) may be separated from the underlying electrode (e.g., electrodes 210 and 410) by a vacuum or gas-filled gap.

Figure 5:
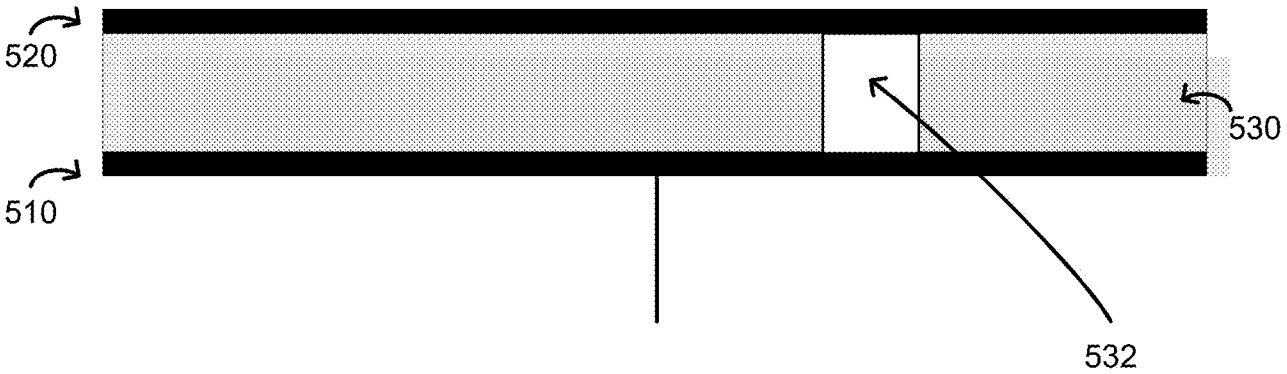
FIG. 5 is a schematic illustration of an example configuration of a grid electrode made of graphene material that is supported over an underlying electrode by an intervening dielectric spacer layer, in accordance with the principles of the disclosure herein.

In an alternate version of the multi-electrode devices of this disclosure, a grid electrode made of graphene materials may be separated from the underlying electrode by a dielectric spacer layer. FIG. 5 shows an example configuration 500 of a grid electrode 520 made of graphene material that is separated from an underlying electrode 510 by a dielectric spacer layer 530. Materials and dimensions of dielectric spacer layer 530 may be selected so that in device operation substantially all of the electron flow to or from electrode 510 can tunnel or transmit through both dielectric spacer layer 530 and grid electrode 520 without being absorbed or scattered. Dielectric spacer layer 530 may, for example, be of the order of a few nanometers thick. Further, like the graphene electrodes discussed in the foregoing, dielectric spacer layer 530 may be a continuous layer or may be a porous layer with holes or apertures (e.g., hole 532) formed in it. The holes of apertures 532 in dielectric spacer layer 530 may be formed, for example, by etching the dielectric material through holes or apertures (e.g., holes 310) in grid electrode 520. In such case, holes of apertures 532 in dielectric spacer layer 530 may form vacuum or gas-filled gaps between electrode s 510 and 520.

In a version of multi-electrode device 100, graphene material of a control grid may be supported by an intervening dielectric material layer disposed on the planar surface of the underlying electrode. The intervening dielectric material layer may be configured to allow tunneling or transmission of the electron flow therethrough. Further, the intervening dielectric material layer may be partially etched to form a porous structure to support the graphene grid over the underlying electrode.

Figure 6:
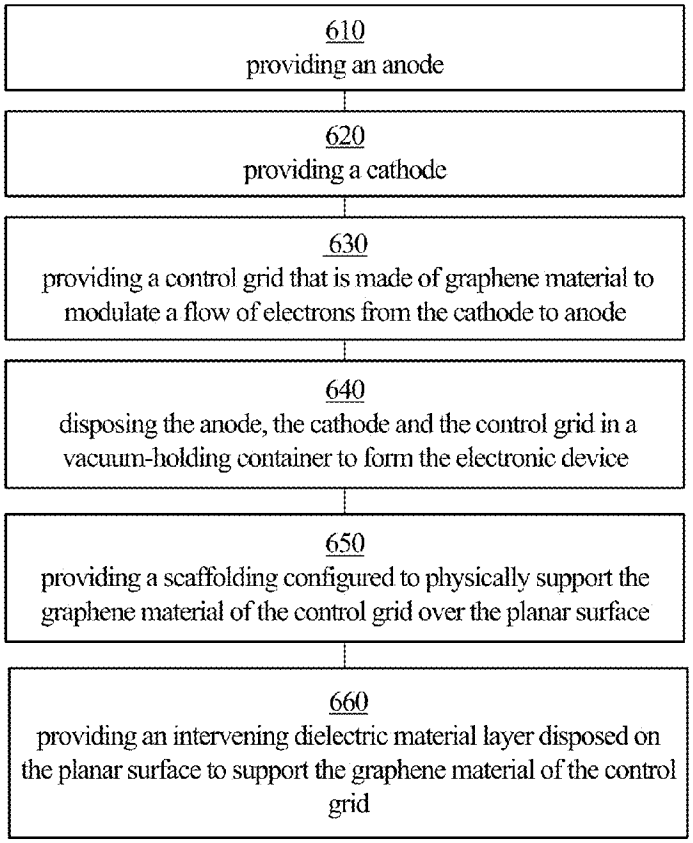
FIG. 6. is a flowchart illustrating an example method for configuring a multi-electrode electronic device (e.g., microelectronic or nanoelectronic device), in accordance with the principles of the disclosure herein.

FIG. 6 shows an example method 600 for configuring a multi-electrode electronic device (e.g., a microelectronic or nanoelectronic device). Method 600 includes providing an anode (610), providing a cathode (620) and providing a control grid that is made of graphene material to modulate a flow of electrons from the cathode to anode (630). Method 600 may include disposing the anode, the cathode and the control grid in a vacuum-holding container to form the electronic device (640).

In method 600, providing a control grid that is made of graphene material to modulate a flow of electrons from the cathode to anode 630 may include disposing the control grid sufficiently close to the cathode (or anode) to induce or suppress electron emission from the cathode (or anode) when an electric potential is applied to the grid in device operation. The graphene material may include unilayer and/or bilayer graphene. Further, the graphene material of the control grid may include a graphene sheet having an area of more than 0.1 $\mu m^2$. In method 600, the graphene material of the control grid may be substantially transparent to the flow electrons from the cathode to the anode. The graphene material of the control grid may, for example, include a graphene sheet with physical holes or pores formed therein. The pores may have cross-sectional areas in a range of about 1 $nm^2$-100 $nm^2$, 100 $nm^2$-1000 $nm^2$, etc. The pores in the graphene sheet may be formed lithographically, formed by copolymer block lithography, and/or by electron-beam or ion-beam drilling. The pores in the graphene sheet may be aligned with field emitter tips on the anode.

At least one of the anode and the cathode may have a substantially planar surface on a micro- or nanometer scale. Providing a control grid that is made of graphene material to modulate a flow of electrons from the cathode to anode 630 may include disposing the graphene material of the control grid over the planar surface. A separation distance between the graphene material and the planar surface may be less than about 1 μm. In some experimental investigations of suspended graphene sheets, a separation distance between the graphene material and the planar surface is about 0.3 μm. In some device applications, the separation distance between the graphene material and the planar surface may be less than about 0.1 μm.

Method 600 may further include providing a scaffolding configured to physically support the graphene material of the control grid over the planar surface (650). The scaffolding may include an array of spacers or support posts, which are electrically isolated from the planar surface. The spacers or support posts may be made from one or more of dielectrics, oxides, polymers, insulators and glassy material.

Method 600 may further include providing an intervening dielectric material layer disposed on the planar surface to support the graphene material of the control grid (660). The intervening dielectric material layer may be configured to allow tunneling or transmission of the electron flow therethrough. The intervening dielectric material layer may be partially etched to form a porous structure to support the graphene grid.

Figure 7:
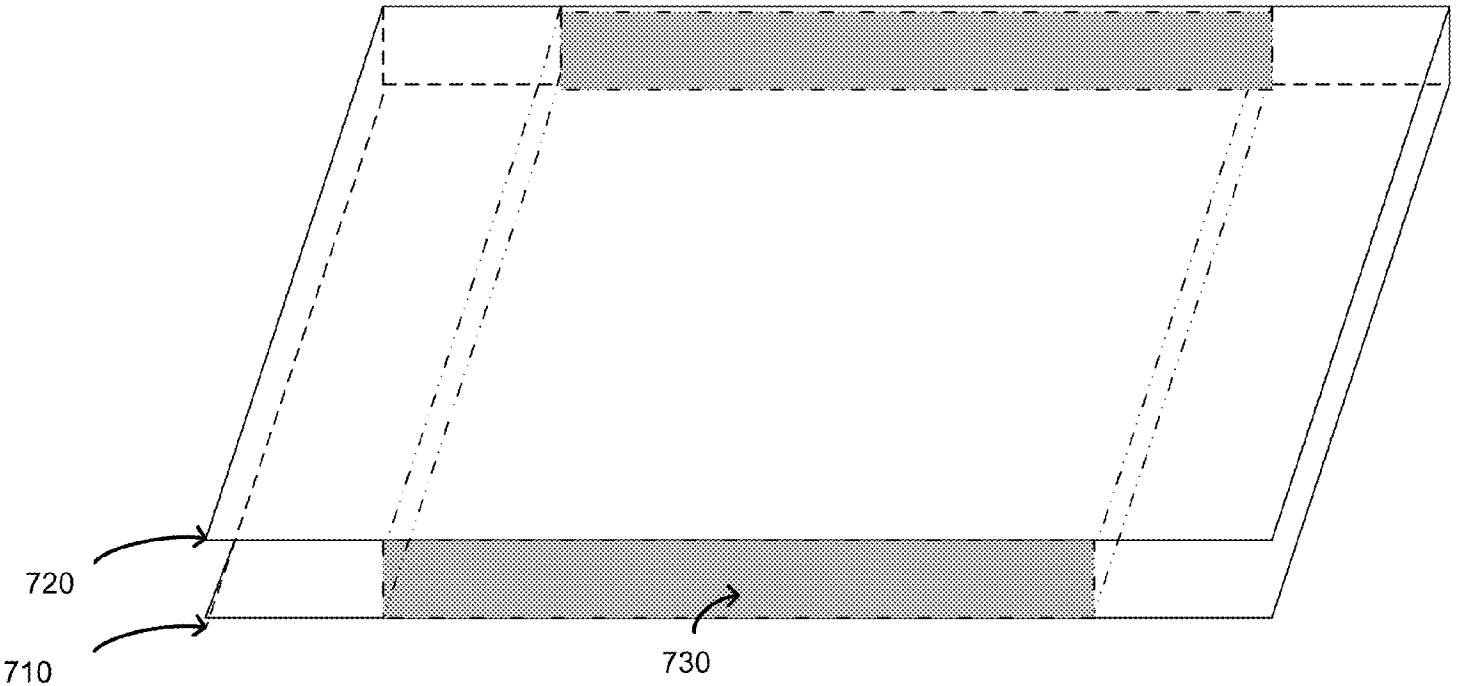
FIG. 7 is a schematic illustration of an example arrangement of a pair of electrodes, which may be used in an electronic device, in accordance with the principles of the disclosure herein.

FIG. 7 shows an example arrangement 700 of a pair of electrodes (e.g., first electrode 710 and second electrode 720), which may be used in an electronic device. The pair of electrodes 710 and 720 may be disposed in a vacuum-holding container (e.g., container 130, FIG. 1). Second electrode 720 may be disposed in close proximity to first electrode 710 and configured to modulate or change an energy barrier to a flow of electrons through the surface of first electrode 710. Additionally or alternatively, second electrode 720 may be disposed in the vacuum-holing container and configured to modulate a flow of electrons through the second electrode itself (e.g., by controlling space charge in the vacuum-holding container).

Second electrode 720 may be made of a 2-d layered material including one or more of graphene, graphyne, graphdiyne, a two-dimensional carbon allotrope, and a two-dimensional semimetal material. The 2-d layered material may have an electron transmission probability for 1 eV electrons that exceeds 0.25 and/or an electron transmission probability for 10 eV electrons that exceeds 0.5.

The 2-d layered material of which the second electrode is made may have an electronic bandgap therein, for example, to permit transmission of the electron flow therethrough in operation of device. The 2-d layered material may, for example, be doped graphene material or functionalized graphene material.

Second electrode 720 may be disposed next to a surface of first electrode 710 so that it is separated by a vacuum gap from at least a portion of the surface of first electrode 710. Alternatively or additionally, second electrode 720 may be disposed next to the surface of first electrode 710 supported by a dielectric material layer 730 disposed over the surface of first electrode 710. Dielectric material layer 730 disposed over the surface of first electrode 710 may be about 0.3 nm-10 nm thick in some applications. In other applications, dielectric material layer 730 may be greater than 10 nm thick.

Dielectric material layer 730 disposed over the surface of first electrode 710 may be a continuous dielectric material layer which is configured to allow tunneling or transmission therethrough of substantially all electron flow to and from the first electrode in device operation. Dielectric material layer 730 may, for example, be a porous dielectric material layer configured to permit formation of vacuum gaps between first electrode 710 and second electrode 720. The 2d-layer material of second electrode 720 may have pores therein permitting chemical etching therethrough to remove portions of dielectric material layer 730 to form, for example, the vacuum gaps.

Figure 8:
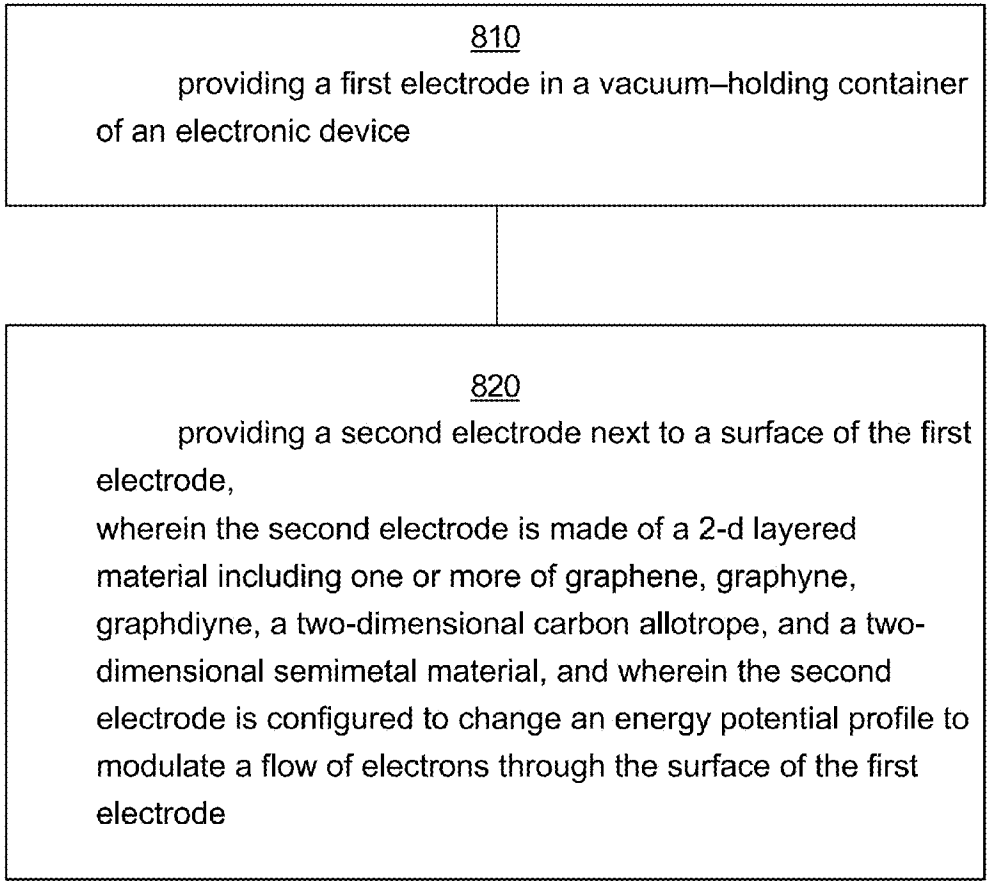
FIG. 8 is a flowchart illustrating an example method for configuring a multi-electrode electronic device, in accordance with the principles of the disclosure herein.

FIG. 8 shows an example method 800 for configuring a multi-electrode electronic device (e.g., a microelectronic or nanoelectronic device). Method 800 includes providing a first electrode in a vacuum-holding container of the electronic device (810), and providing a second electrode next to a surface of the first electrode (820). The second electrode may be made of a 2-d layered material including one or more of graphene, graphyne, graphdiyne, a two-dimensional carbon allotrope, and a two-dimensional semimetal material, and configured to change an energy potential profile to modulate a flow of electrons through the surface of the first electrode. wherein the second electrode is configured to change an energy potential profile to modulate a flow of electrons through a surface of the first electrode and/or the second electrode itself.

In method 800, providing a second electrode made of a 2-d layered material 820 may include using a 2-d layered material having an electron transmission probability that for 1 eV electrons exceeds 0.25 and/or an electron transmission probability that for 10 eV electrons exceeds 0.5. Further, providing a second electrode made of a 2-d layered material 820 may include using a 2-d layered material that has an electronic bandgap therein. Method 800 may include selecting the electronic bandgap of the 2-d layered material so as to permit transmission of or forbid the electron flow therethrough based on the electron energy in operation of the electronic device. The 2-d layered material having an electronic band gap may be doped graphene material and/or functionalized graphene material.

In method 800, disposing a second electrode made of a 2-d layered material next to a surface of the first electrode may include forming a vacuum gap between the 2-d layered material and the surface of the first electrode. Disposing a second electrode made of a 2-d layered material next to a surface of the first electrode 820 may include disposing a dielectric material layer to support the 2-d layered material over the surface of the first electrode. In some applications, the dielectric material layer may be about 0.3 nm-10 nm thick. In other applications, the dielectric material layer may, for example, be greater than about 10 nm thick.

Further, disposing a dielectric material layer to support the 2-d layered material over the surface of the first electrode may include disposing a continuous dielectric material layer, which is configured to allow transmission of substantially all of the electron flow therethrough to and from the first electrode in operation of the electronic device. Method 800 may include removing portions of the dielectric material layer away to permit formation of vacuum gaps between the first electrode and the 2-d layered material of the second electrode. The 2-d layered material may have pores therein, and removing portions of the dielectric material layer involve chemically etching the portions of the dielectric material through the pores in the 2-d layered material.

The dimensions and materials of the devices described herein may be selected for device operation with grid and anode voltages relative to the cathode in suitable ranges. In one embodiment the dimensions and materials of a device may be selected for device operation with grid and anode voltages relative to the cathode, for example, in the range of 0 to 20 volts. In another embodiment the dimensions and materials of a device may be selected for device operation with grid and anode voltages relative to the cathode, for example, in the range of 0 to 40 volts. In yet another embodiment the dimensions and materials of a device may be selected for device operation with grid and anode voltages relative to the cathode, for example, in the range of 0 to 100 volts.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A field emission device, comprising:

an anode and a cathode disposed in a vacuum-holding container, wherein the cathode at least over a part of its extent is separated from the anode by a vacuum gap, wherein electrons are configured to flow between the cathode and the anode; and a first grid interposed between the anode and cathode, the first grid configured to modulate the flow of electrons between the cathode and anode, wherein the first grid comprises a plurality of pores configured to permit passage of the flow of electrons through the first grid and between the cathode and anode, wherein the pores have cross-sectional areas of between 1 $nm^2$ and 1000 $nm^2$, wherein the first grid is made of graphene material.

2. The device of claim 1 configured for device operation with grid and anode voltages relative to the cathode in the range of about 0 to 20 volts.

3. The device of claim 1, wherein at least one of the cathode and the anode comprises field enhancement features.

4. The device of claim 1, wherein the first grid is suspended between the cathode and the anode without physically contacting either the cathode or the anode.

5. The device of claim 1, wherein the first grid is disposed at a closer distance to the anode than a distance to the cathode and is configured to predominantly control the flow of electrons into the anode over control of the flow of electrons out of the cathode when an electric potential is applied to the first grid in device operation.

6. The device of claim 1, further comprising a second grid in addition to the first grid.

7. The device of claim 1, wherein the first grid is configured to act as a screen grid to reduce parasitic capacitance and oscillations.

8. The device of claim 1, wherein the first grid is disposed sufficiently close to the anode to induce electron emission from the anode when an electric potential is applied to the first grid in device operation.

9. The device of claim 1, wherein the first grid is configured to act as an acceleration grid to accelerate a flow of electrons between the cathode and anode.

10. The device of claim 1, wherein the graphene material of the first grid is substantially transparent to the flow of electrons between the cathode to the anode.

11. The device of claim 1, wherein the graphene material includes a graphene sheet with physical pores with carbon atoms removed formed therein.

12. The device of claim 11, wherein the pores in the graphene sheet are aligned with field emitter tips on the cathode or the anode.

13. The device of claim 11, wherein the pores in the graphene sheet are lithographically formed.

14. The device of claim 1, wherein the graphene material of the first grid includes bilayer graphene.

15. The device of claim 1, wherein the graphene material of the first grid includes functionalized graphene and/or doped graphene.

16. The device of claim 1, wherein the graphene material of the first grid includes a graphene allotrope.

17. The device of claim 1, wherein the graphene material of the first grid is disposed over a surface of the anode or the cathode.

18. The device of claim 17, wherein a separation distance between the graphene material of the first grid and the surface of the anode or the cathode is less than about 0.1 μm.

19. The device of claim 17, further comprising a scaffolding configured to physically support the graphene material of the first grid over the surface of the anode or the cathode.

20. The device of claim 19, wherein the scaffolding comprises an array of spacers or support posts.

21. The device of claim 20, wherein the spacers include one or more of dielectrics, oxides, polymers, insulators and glassy material.

22. The device of claim 17, wherein the graphene material of the first grid is supported by an intervening dielectric material layer disposed on the surface of the anode or the cathode.

23. The device of claim 22, wherein the intervening dielectric material layer is configured to allow transmission of the electron flow therethrough.

24. A method, comprising providing an anode in a vacuum-holding container to form an electronic field emission device;

providing a cathode in the vacuum-holding container, wherein the cathode at least over a part of its extent is separated from the anode by a vacuum gap, wherein electrons are configured to flow between the cathode and the anode; and providing a first grid interposed between the anode and cathode to modulate the flow of electrons between the cathode and the anode, wherein the first grid comprises a plurality of pores configured to permit passage of the flow of electrons through the first grid and between the cathode and anode, wherein the pores have cross-sectional areas of between 1 $nm^2$ and 1000 $nm^2$, wherein the first grid is made of graphene material.

25. The method of claim 24, wherein the electronic device is configured for device operation with grid and anode voltages relative to the cathode in the range of about 0 to 40 Volts.

26. The method of claim 24, wherein the first grid is disposed at a closer distance to the anode than a distance to the cathode and is configured to predominantly control the flow of electrons into the anode over control of the flow of electrons out of the cathode when an electric potential is applied to the first grid in device operation.

27. The method of claim 24, further comprising providing a second grid in addition to the first grid.

28. The method of claim 27, wherein the first grid and/or the second grid are configured to act as a screen grid to reduce parasitic capacitance and oscillations.

29. The method of claim 24, wherein the graphene material of the grid has a material property so that the graphene material is substantially transparent to the flow of electrons between the cathode to the anode.

30. The method of claim 24, wherein the graphene material includes a graphene sheet with physical pores formed therein.

31. The method of claim 24, further comprising providing an intervening dielectric material layer disposed on the surface of the anode or the cathode to support the graphene material of the grid.

32. The method of claim 31, wherein the intervening dielectric material layer is configured to allow transmission of the electron flow therethrough.

33. The method of claim 31, wherein the intervening dielectric material layer is partially etched to form a porous structure to support the graphene grid.

34. An electronic field emission device, comprising, a first electrode disposed in a vacuum-holding container; and a second electrode disposed in the vacuum-holding container, the second electrode separated from the first electrode by a vacuum gap, wherein the second electrode is made of a 2-d layered material including one or more of graphene, graphyne, graphdiyne, a two-dimensional carbon allotrope, and a two-dimensional semimetal material, and wherein the second electrode comprises a plurality of pores configured to permit passage of a flow of electrons from the first electrode and through the second electrode, wherein the pores have cross-sectional areas of between 1 $nm^2$ and 1000 $nm^2$, wherein the second electrode is configured to modulate or change an energy barrier to the flow of electrons from the first electrode and across the vacuum gap separating the first electrode from the second electrode.

35. The electronic device of claim 34, wherein the second electrode is made of a 2-d layered material having a material property of an electron transmission probability for 1 eV electrons that exceeds 0.25.

36. The electronic device of claim 34, wherein the second electrode is made of a 2-d layered material having an electronic bandgap therein, and wherein the electronic bandgap of the 2-d layered material is such as to permit transmission of the electron flow therethrough in operation of device.

37. The electronic device of claim 34, wherein a dielectric material layer disposed over the surface of the first electrode is a porous dielectric material layer configured to permit formation of vacuum gaps between the first electrode and the second electrode.

38. The electronic device of claim 37, wherein the 2-d layer material of the second electrode has pores therein permitting chemical etching therethrough to remove portions of the dielectric material.

39. The electronic device of claim 34, further comprising circuitry configured to impose an electrical potential between the first and second electrodes.

40. A method, comprising, providing a first electrode in a vacuum-holding container of an electronic field emission device; and providing a second electrode in the vacuum-holding container, the second electrode separated from the first electrode by a vacuum gap, wherein the second electrode is made of a 2-d layered material including one or more of graphene, graphyne, graphdiyne, a two-dimensional carbon allotrope, and a two-dimensional semimetal material, and wherein the second electrode comprises a plurality of pores configured to permit passage of a flow of electrons from the first electrode and through the second electrode, wherein the pores have cross-sectional areas of between 1 $nm^2$ and 1000 $nm^2$, wherein the second electrode is configured to change an energy potential profile to modulate the flow of electrons from the first electrode and across the vacuum gap separating the first electrode from the second electrode.

41. The method of claim 40, further comprising selecting an electronic bandgap of the 2-d layered material so as to permit or forbid transmission of the electron flow therethrough based on electron energy in operation of the electronic device; and using a 2-d layered material having an electron transmission probability that for 10 eV electrons exceeds 0.50.

42. The method of claim 10, further comprising providing circuitry to impose an electrical potential between the first and second electrodes.

* * * * *